US010716170B2

(12) United States Patent
Chen et al.

(10) Patent No.: US 10,716,170 B2
(45) Date of Patent: Jul. 14, 2020

(54) HEATING APPARATUS WITH AUTOMATIC SWITCHING HEATERS AND METHOD OF OPERATING THE SAME

(71) Applicant: Delta Electronics, Inc., Taoyuan (TW)

(72) Inventors: Lee-Lung Chen, Taoyuan (TW); Shih-Yu Lai, Taoyuan (TW); Wu-Chi Lee, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 317 days.

(21) Appl. No.: 15/830,857

(22) Filed: Dec. 4, 2017

(65) Prior Publication Data

US 2018/0227985 A1 Aug. 9, 2018

(30) Foreign Application Priority Data

Feb. 8, 2017 (CN) ..... 2017 1 0069535

(51) Int. Cl.
*H05B 1/02* (2006.01)

(52) U.S. Cl.
CPC ..... *H05B 1/02* (2013.01); *H05B 1/023* (2013.01)

(58) Field of Classification Search
CPC ..... H05B 1/02; H05B 1/023
USPC ..... 219/509
See application file for complete search history.

(56) References Cited

U.S. PATENT DOCUMENTS

| | | | | |
|---|---|---|---|---|
| 8,796,592 | B2 * | 8/2014 | Berberich | G01N 1/312 219/483 |
| 2011/0174801 | A1 * | 7/2011 | Schwerman | H03K 7/10 219/509 |
| 2015/0053151 | A1 * | 2/2015 | Graff | F24H 9/2035 122/14.21 |
| 2017/0047774 | A1 * | 2/2017 | Rezeanu | H02J 7/047 |
| 2018/0184484 | A1 * | 6/2018 | Mihira | H04W 4/80 |

FOREIGN PATENT DOCUMENTS

| | | | |
|---|---|---|---|
| CN | 101451763 | A | 6/2009 |
| CN | 202077003 | U | 12/2011 |
| CN | 202906807 | U | 4/2013 |
| CN | 106230420 | A | 12/2016 |

* cited by examiner

*Primary Examiner* — Huyen D Le
(74) *Attorney, Agent, or Firm* — Muncy, Geissler, Olds & Lowe, PC

(57) ABSTRACT

A heating apparatus with automatic switching heaters includes a control module, a switch module, and a heating module. The control module receives an input power source. The switch module is connected to the control module. The heating module is connected to the switch module. When the control module detects that an amplitude of the input power source is larger than a threshold voltage value, the control module turns on a first switch assembly and turns off a second switch assembly of the switch module so that the heating module operates in a first heating mode. When the control module detects that the amplitude of the input power source is less than the threshold voltage value, the control module turns on the first switch assembly and the second switch assembly of the switch module so that the heating module operates in a second heating mode.

14 Claims, 5 Drawing Sheets

HEATING APPARATUS WITH AUTOMATIC SWITCHING HEATERS AND METHOD OF OPERATING THE SAME

BACKGROUND

Technical Field

The present invention relates generally to a heating apparatus and a method of operating the same, and more particularly to a heating apparatus with automatic switching heaters and a method of operating the same.

Description of Related Art

In the applications of communication cabinets, electronic apparatuses contained inside the communication cabinet tend to fail or are easily damaged by a power interruption or a short circuit due to frost or freeze inside the communication cabinet operated under a low-temperature condition. Therefore, heating apparatuses are usually installed inside the communication cabinet and operated to raise the temperature of the communication cabinet under the low-temperature condition. Accordingly, electronic elements and/or electronic apparatuses inside the communication cabinet are protected and operate under a normal-temperature condition.

In addition, using the heating apparatuses installed inside the communication cabinet may cause inconvenience of user; this is due to different voltage levels of utility power sources in different regions or countries. When the voltage level of the utility power source fails to meet the heating apparatuses, the heating apparatuses would have a lack of heating performance or be damaged.

Refer to FIG. 1, which shows a schematic circuit block diagram of a conventional heating apparatus. In general, the heating apparatuses 100A, 100B have to connect to correct voltage levels of input power sources so that the heating apparatuses 100A, 100B could normally operate. For example, a first heater assembly 62A (AC 220 volts-500 watts of rated power) of the heating apparatus 100A normally operates to generate sufficient output power when the heating apparatus 100A is connected to a 220-volt AC input power source. Similarly, a second heater assembly 64A (AC 110 volts-500 watts of rated power) of the heating apparatus 100B normally operates to generate sufficient output power when the heating apparatus 100B is connected to a 110-volt AC input power source.

Therefore, the conventional heating apparatuses have the following disadvantages:

1. The correct voltage level of the input power source is strictly required for the heating apparatuses. When the voltage level of the input power source fails to meet the heating apparatuses, the heating apparatuses would have a lack of heating performance or be damaged.

2. No automatic switch function is provided for the heating apparatus based on different voltage levels of the input power sources. It is not convenient for user to normally use the heating apparatuses not equipped with auto-switching mechanism, since each of this heating apparatuses has to connect to correct voltage level of the input power source.

SUMMARY

In order to solve the above-mentioned problem, the present disclosure provides a heating apparatus with automatic switching heaters. The heating apparatus with automatic switching heaters includes a control module, a switch module, and a heating module. The control module receives an input power source. The switch module is connected to the control module. The heating module is connected to the switch module. When the control module detects that an amplitude of the input power source is greater than a threshold voltage value, the control module outputs a control signal to control the switch module, and the switch module switches the heating module to operate in a first heating mode. When the control module detects that the amplitude of the input power source is less than the threshold voltage value, the control module outputs the control signal to control the switch module, and the switch module switches the heating module to operate in a second heating mode.

In one embodiment, the switch module includes a first switch assembly and a second switch assembly. The first switch assembly is connected to the control module and the heating module. The second switch assembly is connected to the control module and the heating module. When the heating module operates in the first heating mode, the control module turns on the first switch assembly and turns off the second switch assembly. When the heating module operates in the second heating mode, the control module turns on the first switch assembly and the second switch assembly.

In one embodiment, the control module includes a detection unit. The detection unit receives the input power source and the detection unit includes a rectifying unit and a level output unit. The rectifying unit receives the input power source. The level output unit is connected to the rectifying unit. The rectifying unit rectifies the input power source into a DC power source. When the level output unit determines that an amplitude of the DC power source is greater than a voltage value corresponding to the threshold voltage value, the level output unit outputs a detection signal with a first level, and the control module controls the heating module operating in the first heating mode according to the detection signal with the first level. When the level output unit determines that the amplitude of the DC power source is less than the voltage value corresponding to the threshold voltage value, the level output unit outputs the detection signal with a second level, and the control module controls the heating module operating in the second heating mode according to the detection signal with the second level.

In one embodiment, the level output unit includes a comparison unit and a photo coupling unit. The comparison unit is connected to the rectifying unit. The photo coupling unit is connected to the comparison unit. The comparison unit controls the photo coupling unit according to an amplitude relationship between the amplitude of the DC power source and the voltage value corresponding to the threshold voltage value. When the amplitude of the DC power source is greater than the voltage value corresponding to the threshold voltage value, the comparison unit turns on the photo coupling unit, and the photo coupling unit outputs the detection signal with the first level. When the amplitude of the DC power source is less than the voltage value corresponding to the threshold voltage value, the comparison unit turns off the photo coupling unit, and the photo coupling unit outputs the detection signal with the second level.

In one embodiment, the control module further includes a control unit. The control unit is connected to the detection unit and the switch module. After the detection unit receives the input power source, the detection unit outputs the detection signal to the control unit, and the control unit controls the heating module operating in the first heating mode or the second heating mode. When the detection unit determines that the amplitude of the input power source is greater than the threshold voltage value, the control unit controls the heating module operating in the first heating mode according to the detection signal. When the detection unit determines that the amplitude of the input power source is less than the threshold voltage value, the control unit controls the heating module operating in the second heating mode according to the detection signal.

In one embodiment, the control module further includes a delay unit. The delay unit is connected to the control unit and outputs a delay time to the control unit. After a period of the delay time since the control unit receives the detection signal, the control unit outputs the control signal to the switch module.

In one embodiment, the threshold voltage value is AC 150 volts. When the amplitude of the input power source is AC 220 volts, the level output unit determines that the amplitude of the DC power source is greater than the voltage value corresponding to the threshold voltage value. When the amplitude of the input power source is AC 110 volts, the level output unit determines that the amplitude of the DC power source is less than the voltage value corresponding to the threshold voltage value.

In one embodiment, the comparison unit includes a voltage dividing loop and a switch. The voltage dividing loop includes a Zener diode and a first resistor connected in series to the Zener diode. The switch is connected to the Zener diode, the first resistor, and the photo coupling unit. When the amplitude of the DC power source is greater than the voltage value corresponding to the threshold voltage value, a voltage across the first resistor is turned on the switch and the photo coupling unit, and the photo coupling unit outputs the detection signal with the first level. When the amplitude of the DC power source is less than the voltage value corresponding to the threshold voltage value, the voltage across the first resistor is turned off the switch and the photo coupling unit, and the photo coupling unit outputs the detection signal with the second level.

In one embodiment, the comparison unit includes a voltage dividing circuit and a voltage dividing loop. The voltage dividing circuit includes a first resistor and a second resistor connected in series to the first resistor. The voltage dividing loop includes a comparator and a switch connected to the comparator; one input terminal of the comparator is connected to the first resistor and the second resistor, and the switch is connected to the other input terminal of the comparator and the photo coupling unit. When the amplitude of the DC power source is greater than the voltage value corresponding to the threshold voltage value, the comparator turns on the photo coupling unit by turning on the switch, and the photo coupling unit outputs the detection signal with the first level. When the amplitude of the DC power source is less than the voltage value corresponding to the threshold voltage value, the comparator turns off the photo coupling unit by turning off the switch, and the photo coupling unit outputs the detection signal with the second level.

In one embodiment, the heating module includes a first heater assembly and a second heater assembly. The first heater assembly is connected to the first switch assembly. The second heater assembly is connected to the second switch assembly. When the first switch assembly is turned on and the second switch assembly is turned off, the first heater assembly generates output power and raises the temperature. When the first switch assembly and the second switch assembly are turned on, the first heater assembly and the second heater assembly generate output power and raise the temperature.

In one embodiment, the control unit first turns on the second switch assembly and then turns on the first switch assembly when both the first heater assembly and the second heater assembly generate output power and raise the temperature.

In one embodiment, a total output power generated from the heating module in the first heating mode is equal to the total output power generated from the heating module in the second heating mode.

In order to solve the above-mentioned problem, the present disclosure provides a method of operating a heating apparatus with automatic switching heaters. The method includes: (a) providing a control module to receive an input power source; (b) determining whether an amplitude of the input power source is greater than or less than a threshold voltage value by the control module; (c) switching a heating module to operate in a first heating mode by the control module when the amplitude of the input power source is greater than the threshold voltage value; and (d) switching the heating module to operate in a second heating mode by the control module when the amplitude of the input power source is less than the threshold voltage value.

In one embodiment, the step (c) further includes: (c1) generating output power from a first heater assembly of the heating module and raising the temperature when the heating module operates in the first heating mode.

In one embodiment, the step (d) further includes: (d1) generating output power from a first heater assembly and a second heater assembly of the heating module and raising the temperature when the heating module operates in the second heating mode.

In one embodiment, the step (d) further includes: (d2) the control module first controlling the second heater assembly raised the temperature and then controlling the first heater assembly raised the temperature when the heating module raised the temperature by the first heater assembly and the second heater assembly.

In one embodiment, the step (b) further includes: (b1) providing a detection unit and a control unit connected to the detection unit of the control module, and receiving a delay time by the control unit; outputting a detection signal to the control unit by the detection unit after the detection unit determines an amplitude relationship between the amplitude of the input power source and the threshold voltage value; switching the heating module to operate in the first heating mode or in the second heating mode by a switch module after a period of the delay time since the control unit receives the detection signal.

In one embodiment, a total output power generated from the heating module in the first heating mode is equal to the total output power generated from the heating module in the second heating mode.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWING

The present disclosure can be more fully understood by reading the following detailed description of the embodiment, with reference made to the accompanying drawings as follows.

DETAILED DESCRIPTION

Figure 1:
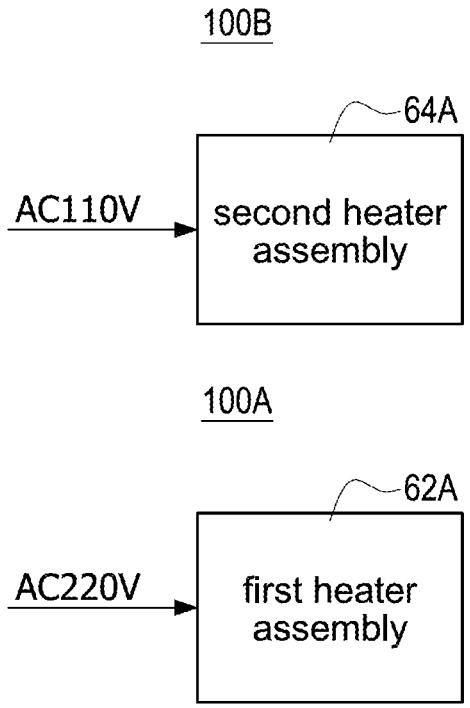
FIG. 1 is a schematic circuit block diagram of a conventional heating apparatus.

Reference will now be made to the drawing figures to describe the present disclosure in detail.

Figure 2:
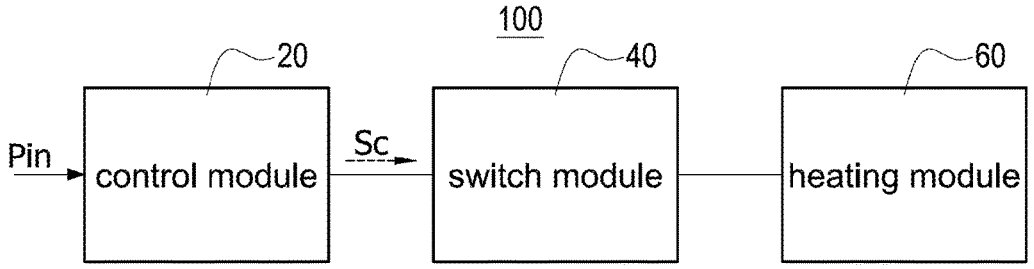
FIG. 2 is a schematic circuit architecture diagram of a heating apparatus with automatic switching heaters according to the present disclosure.

Refer to FIG. 2, which shows a schematic circuit architecture diagram of a heating apparatus with automatic switching heaters according to the present disclosure. The heating apparatus 100 includes a control module 20, a switch module 40, and a heating module 60. The control module 20 is connected to the switch module 40, and the switch module 40 is connected to the heating module 60. The control module 20 receives an input power source Pin and outputs a control signal Sc to control the switch module 40. When the control module 20 turns on the switch module 40, the heating module 60 generates output power to heat a target object (not shown), thereby raising the temperature of the target object. In one example, the heating apparatus 100 is, but not limited to, a communication cabinet and the target object is, but not limited to, an electronic apparatus installed inside the communication cabinet. In other words, the heating apparatus 100 provides heating performance to avoid damaging electronic apparatuses due to frost or freeze inside the communication cabinet.

Figure 3:
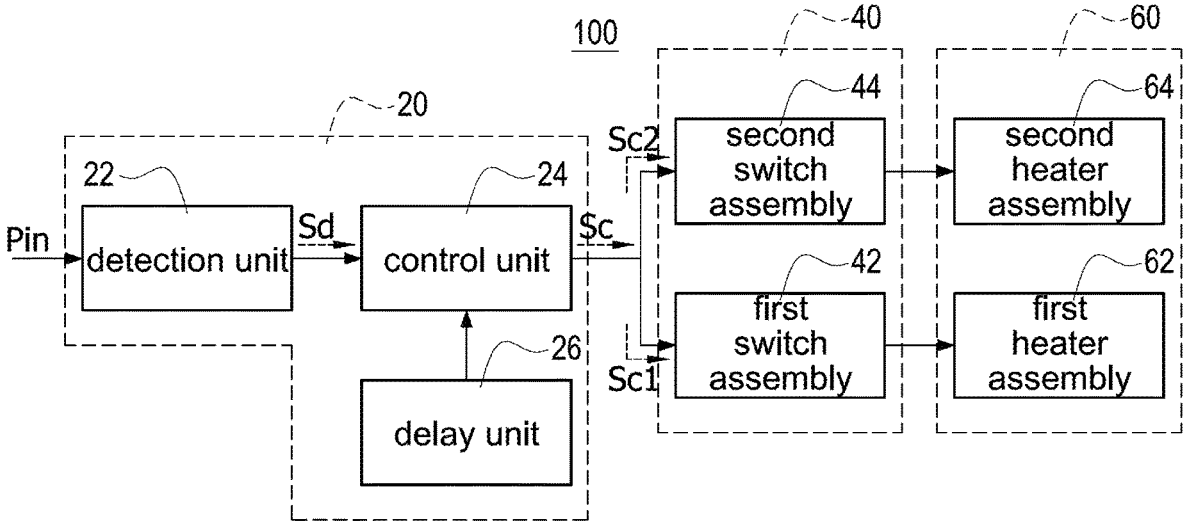
FIG. 3 is a schematic circuit block diagram of the heating apparatus with automatic switching heaters according to the present disclosure.

Refer to FIG. 3, which shows a schematic circuit block diagram of the heating apparatus with automatic switching heaters according to the present disclosure. The control module 20 includes a detection unit 22 and a control unit 24, and the detection unit 22 is connected to the control unit 24. The detection unit 22 receives the input power source Pin and outputs a detection signal Sd to the control unit 24. The switch module 40 includes a first switch assembly 42 and a second switch assembly 44. The first switch assembly 42 and the second switch assembly 44 are connected to the control unit 24 of the control module 20. After the control unit 24 receives the detection signal Sd, the control unit 24 outputs a first control signal Sc1 of the control signal Sc to control the first switch assembly 42, and outputs a second control signal Sc2 of the control signal Sc to control the second switch assembly 44. The heating module 60 includes a first heater assembly 62 and a second heater assembly 64. The first heater assembly 62 is connected to the first switch assembly 42, and the second heater assembly 64 is connected to the second switch assembly 44. When the first switch assembly 42 is turned on, the first heater assembly 62 generates output power and raises the temperature. When the second switch assembly 44 is turned on, the second heater assembly 64 generates output power and raises the temperature.

When the detection unit 22 detects the input power source Pin, the detection unit 22 determines whether an amplitude of the input power source Pin is greater than or less than a threshold voltage value T. When the amplitude of the input power source Pin is greater than the threshold voltage value T, the detection unit 22 outputs the detection signal Sd with a first level to the control unit 24. After the control unit 24 receives the detection signal Sd with the first level, the control unit 24 outputs the first control signal Sc1 with a second level to turn on the first switch assembly 42, thereby controlling the first heater assembly 62 to generate output power and raise the temperature. At the same time, the control unit 24 outputs the second control signal Sc2 with a first level to turn off the second switch assembly 44, thereby disabling the second heater assembly 64. The above-mentioned operation mode of the heating apparatus 100 is a first heating mode M1.

When the amplitude of the input power source Pin is less than the threshold voltage value T, the detection unit 22 outputs the detection signal Sd with a second level to the control unit 24. After the control unit 24 receives the detection signal Sd with the second level, the control unit 24 outputs the first control signal Sc1 with a second level to turn on the first switch assembly 42, thereby controlling the first heater assembly 62 to generate output power and raise the temperature. At the same time, the control unit 24 outputs the second control signal Sc2 with a second level to turn on the second switch assembly 44, thereby controlling the second heater assembly 64 to generate output power and raise the temperature. The above-mentioned operation mode of the heating apparatus 100 is a second heating mode M2.

When the heating apparatus 100 operates in the second heating mode M2, the control unit 24 turns on the second switch assembly 44 and then turns on the first switch assembly 42. A multi-stage manner of turning on the first switch assembly 42 and the second switch assembly 44 is implemented to avoid damaging the switch module 40 and/or the heating module 60 due to an overshoot in current when the switch module 40 is instantaneously turned on.

In one example, the first level is, but not limited to, a low level and the second level is a high level relative to the first level. In other words, the first level is a high level and the second level is a low level relative to the first level. For example, the detection unit 22 outputs the detection signal Sd with the first level (high level) to the control unit 24. After the control unit 24 receives the detection signal Sd with the first level (high level), the control unit 24 outputs the first control signal Sc1 with the second level (low level) to turn on the first switch assembly 42, thereby controlling the first heater assembly 62 to generate output power and raise the temperature. Besides the above-mentioned high/low levels, other level scales for determining the input power source Pin and turning on/off the first switch assembly 42 and the second switch assembly 44 would be used in the present disclosure.

As shown in FIG. 3, the control module 20 further includes a delay unit 26. The delay unit 26 is connected to the control unit 24 and outputs a delay time Td to the control unit 24. After a period of the delay time Td since the control unit 24 receives the detection signal Sd, the control unit 24 outputs the control signal Sc to control the first switch assembly 42 and the second switch assembly 44. When the detection unit 22 initially receives the input power source Pin, a voltage value (level) of the detection signal Sd outputted from the detection unit 22 is not yet stable so that the control unit 24 is in a malfunction control to damage the heating apparatus 100. Accordingly, the delay unit 26 provides the delay time Td to the control unit 24 so that the control unit 24 outputs the control signal Sc to control the first switch assembly 42 and the second switch assembly 44 after the voltage value (level) of the detection signal Sd is stable. For example, the delay time Td is, but not limited to, five seconds.

Figure 4:
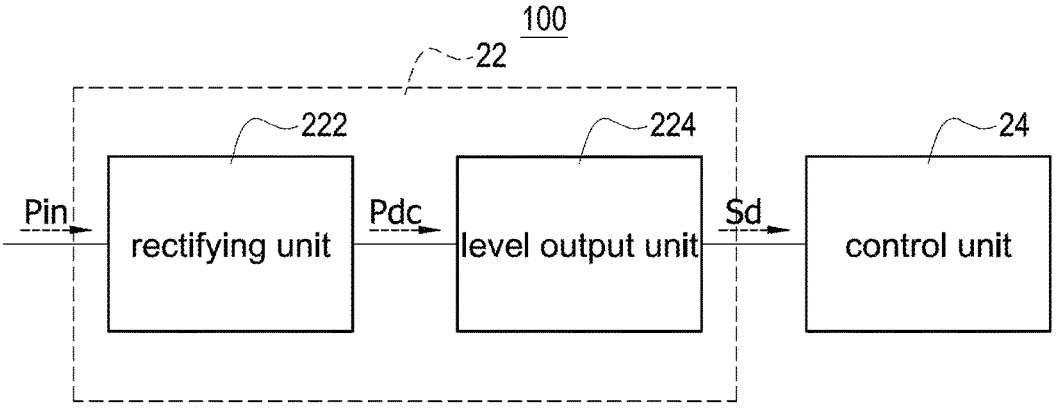
FIG. 4 is a schematic circuit block diagram of a detection unit according to the present disclosure.

Refer to FIG. 4, which shows a schematic circuit block diagram of a detection unit according to the present disclosure. The detection unit 22 includes a rectifying unit 222 and a level output unit 224. The rectifying unit 222 is connected to the level output unit 224. The rectifying unit 222 receives the input power source Pin and rectifies the input power source Pin into a DC power source Pdc. The level output unit 224 determines whether an amplitude of the DC power source Pdc is greater than a voltage value corresponding to the threshold voltage value T or not. In one embodiment, the input power source Pin may be a power source with a wide AC input voltage range of 110 to 220 volts. Also, the rectifying unit 222 rectifies the AC power source with the input voltage range of 110 to 220 volts. For example, the threshold voltage value T is, but not limited to, equal to AC 150 volts, and the voltage value corresponding to the threshold voltage value T is, but not limited to, set to DC 15 volts. Also, the amplitude of the DC power source Pdc may be stepped down to or divided into a converted voltage range of 11 to 22 volts.

When the amplitude of the input power source Pin is less than the threshold voltage value T (AC 150 volts), such as AC 110 volts, the level output unit 224 determines that the converted voltage of the DC power source Pdc is less than DC 15 volts, namely less than the voltage value corresponding to the threshold voltage value T. At this time, the detection unit 22 outputs the detection signal Sd with the second level to the control unit 24. When the amplitude of the input power source Pin is greater than 150 volts, such as AC 220 volts, the level output unit 224 determines that the converted voltage of the DC power source Pdc is greater than DC 15 volts, namely greater than the voltage value corresponding to the threshold voltage value T. At this time, the detection unit 22 outputs the detection signal Sd with the first level to the control unit 24.

Figure 5:
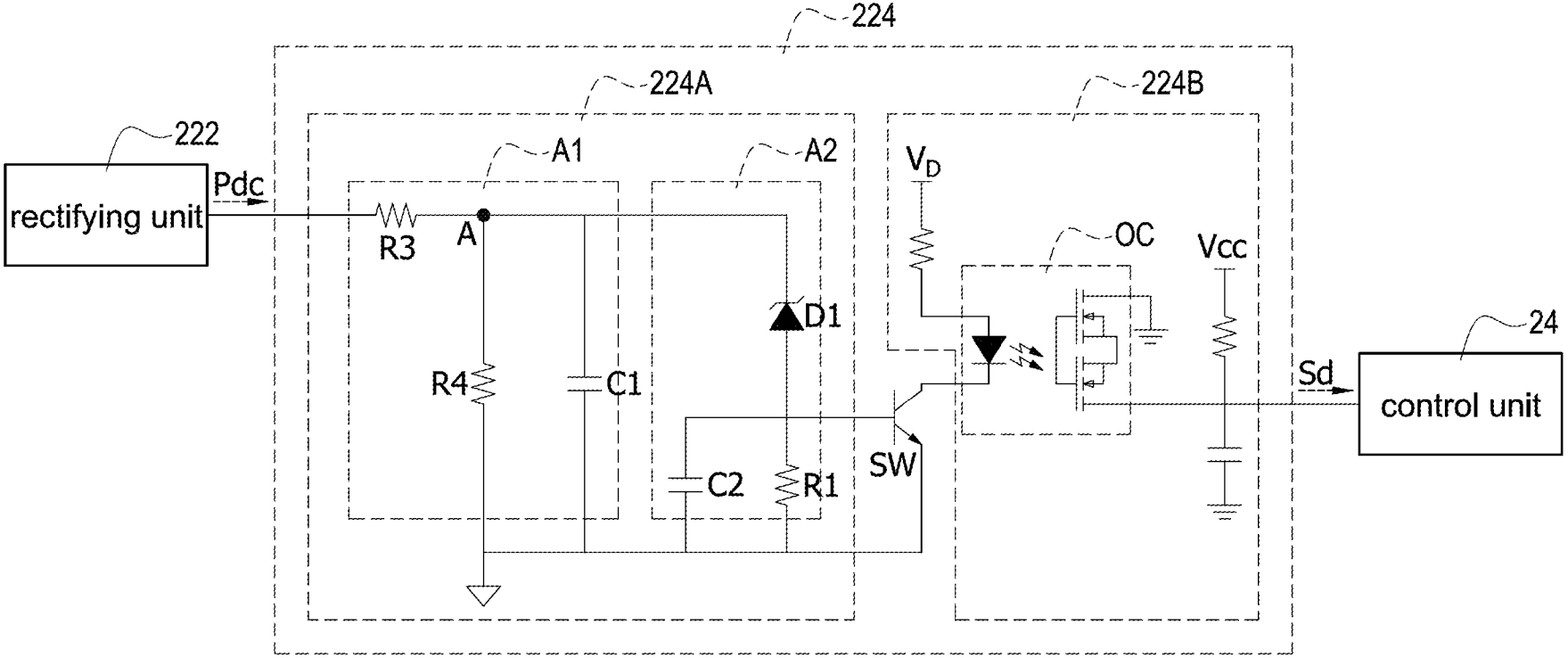
FIG. 5 is a schematic circuit block diagram of a level output unit according to the present disclosure.

Refer to FIG. 5, which shows a schematic circuit block diagram of a level output unit according to the present disclosure. The level output unit 224 is connected between the rectifying unit 222 and the control unit 24. The level output unit 224 includes a comparison unit 224A and a photo coupling unit 224B, and the comparison unit 224A is connected to the photo coupling unit 224B. The comparison unit 224A receives the DC power source Pdc. The comparison unit 224A includes a voltage dividing circuit A1, a voltage dividing loop A2, and a switch SW. The voltage dividing circuit A1 includes a resistor R3, a resistor R4, and a capacitor C1. The resistor R4 is connected in parallel to the capacitor C1, and further connected to the resistor R3. The DC power source Pdc is divided by the resistor R3 and the resistor R4 of the voltage dividing circuit A1 to acquire a voltage value at a voltage-dividing point A, and the voltage value is regulated by the capacitor C1. The voltage dividing loop A2 is connected in parallel to the capacitor C1. The voltage dividing loop A2 includes a Zener diode D1, a first resistor R1, and a capacitor C2. The first resistor R1 is connected in parallel to the capacitor C2, and further connected to the Zener diode D1. A voltage across the first resistor R1 is regulated by the capacitor C2.

When the DC power source Pdc supplies to the comparison unit 224A, the Zener diode D1 is reversely biased by the voltage value at the voltage-dividing point A and a voltage across the Zener diode D1 is established. When the voltage value at the voltage-dividing point A is larger, the voltage across the first resistor R1 is larger. In contrast, the voltage across the first resistor R1 is smaller when the voltage value at the voltage-dividing point A is smaller. The switch SW is connected to the Zener diode D1, the first resistor R1, and the photo coupling unit 224B. When the voltage across the first resistor R1 is larger, the switch SW is turned on. In contrast, the switch SW is turned off when the voltage across the first resistor R1 is smaller. The photo coupling unit 224B includes a photo coupler OC. In particular, when the switch SW is turned on, the photo coupler OC is turned on so as to enable the photo coupling unit 224B. In contrast, the photo coupler OC is turned off when the switch SW is turned off so as to disable the photo coupling unit 224B.

An output terminal of the photo coupling unit 224B is connected to a power source Vcc, a ground point GND, and the switch SW through the photo coupler OC. When the switch SW is turned on, a current path is formed at an input terminal of the photo coupling unit 224B, thereby turning on the photo coupling unit 224B. At this time, the output terminal of the photo coupling unit 224B is connected to the ground point GND. Accordingly, the detection signal Sd with the first level, namely the low/GND level, is outputted from the level output unit 224. When the switch SW is turned off, no current path is formed at the input terminal of the photo coupling unit 224B, thereby turning off the photo coupling unit 224B. At this time, the output terminal of the photo coupling unit 224B is connected to the power source Vcc instead of the ground point GND. Accordingly, the detection signal Sd with the second level, namely the high/Vcc level, is outputted from the level output unit 224.

For example, when the amplitude of the input power source Pin is AC 220 volts, the rectified DC power source Pdc outputted from the rectifying unit 222 is DC 220 volts. By a design of the resistor R3 and the resistor R4 of the voltage dividing circuit A1, a larger voltage value relative to 110 volts is formed at the voltage-dividing point A, and also the voltage across the first resistor R1 is larger. The larger voltage across the first resistor R1 makes the switch SW turn on, thereby turning on the photo coupling unit 224B. When the photo coupling unit 224B is turned on, the output terminal of the photo coupling unit 224B is connected to the ground point GND so that the detection signal Sd with the first level, namely the low/GND level, is outputted from the level output unit 224. For example, when the amplitude of the input power source Pin is AC 110 volts, the rectified DC power source Pdc outputted from the rectifying unit 222 is DC 110 volts. By a design of the resistor R3 and the resistor R4 of the voltage dividing circuit A1, a smaller voltage value relative to 220 volts is formed at the voltage-dividing point A, and also the voltage across the first resistor R1 is smaller. The smaller voltage across the first resistor R1 makes the switch SW turn off, thereby turning off the photo coupling unit 224B.

When the photo coupling unit 224B is turned off, the output terminal of the photo coupling unit 224B is connected to the power source Vcc instead of the ground point GND so that the detection signal Sd with the second level, namely the high/Vcc level, is outputted from the level output unit 224. In this embodiment, the threshold voltage value T and the voltage value corresponding to the threshold voltage value T are determined by the Zener diode D1 and the first resistor R1 of the voltage dividing loop A2. In other words, when parameters of the Zener diode D1 and/or a resistance value of the first resistor R1 are changed, the threshold voltage value T is correspondingly changed.

Figure 6:
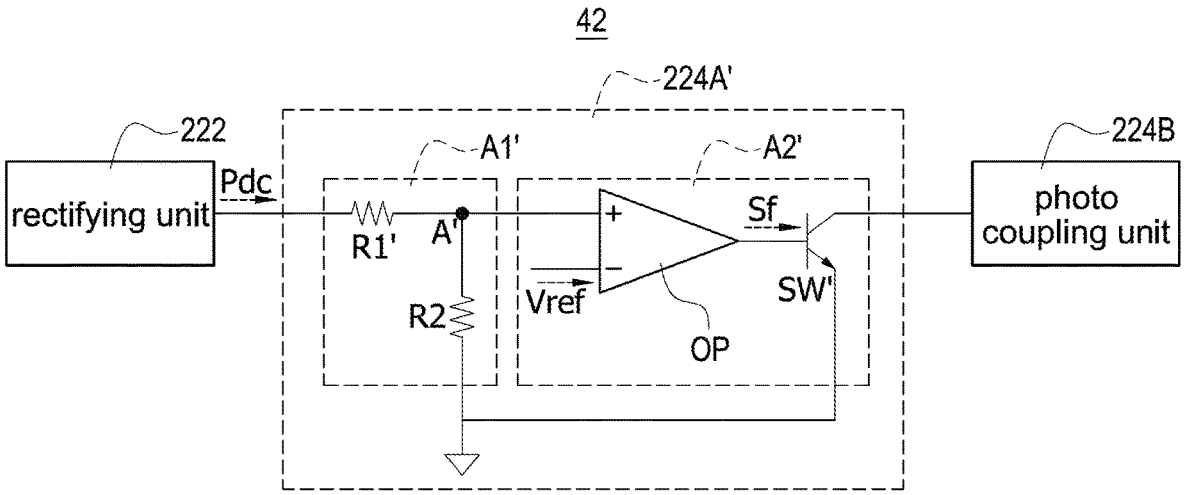
FIG. 6 is a schematic circuit block diagram of a comparison unit according to the present disclosure.

Refer to FIG. 6, which shows a schematic circuit block diagram of a comparison unit according to the present disclosure. A comparison unit 224A' is disclosed in the second embodiment. Comparing to the comparison unit 224A in the first embodiment, the comparison unit 224A' includes a voltage dividing circuit A1' and a voltage dividing loop A2'. The voltage dividing circuit A1' is connected to the voltage dividing loop A2' and receives the DC power source Pdc. The voltage dividing circuit A1' includes a first resistor R1' and a second resistor R2 connected to the first resistor R1'. The voltage dividing loop A2' includes a comparator OP and a switch SW' connected to the comparator OP. One input terminal of the comparator OP is connected to the first resistor R1' and the second resistor R2, and the other input terminal of the comparator OP is connected to a reference voltage Vref.

The switch SW' is connected between an output terminal of the comparator OP and the photo coupling unit 224B to receive a comparison signal Sf outputted from the comparator OP. The comparison signal Sf is provided to control the photo coupling unit 224B. When the DC power source Pdc is detected, a voltage is produced at a voltage-dividing point A' connected between the first resistor R1' and the second resistor R2. The comparator OP is used to compare the voltage at the voltage-dividing point A' with the reference voltage Vref. In one example, the reference voltage Vref is set to the reference voltage value corresponding to the threshold voltage value T.

When the voltage at the voltage-dividing point A' is less than the reference voltage Vref, it means that the converted voltage of the DC power source Pdc is less than the reference voltage value corresponding to the threshold voltage value T. At this time, the comparator OP outputs the comparison signal Sf with the first level to turn off the switch SW', thereby turning off the photo coupling unit 224B so that the detection signal Sd with the second level is outputted from the photo coupling unit 224B to the control unit 24.

When the voltage at the voltage-dividing point A' is greater than the reference voltage Vref, it means that the converted voltage of the DC power source Pdc is greater than the reference voltage value corresponding to the threshold voltage value T. At this time, the comparator OP outputs the comparison signal Sf with the second level to turn on the switch SW', thereby turning on the photo coupling unit 224B so that the detection signal Sd with the first level is outputted from the photo coupling unit 224B to the control unit 24.

In this embodiment, the threshold voltage value T and the voltage value corresponding to the threshold voltage value T are determined by the reference voltage Vref. In other words, when a voltage value of the reference voltage Vref is changed, the threshold voltage value T is correspondingly changed. In this embodiment, the first level of the comparison signal Sf is, but not limited to, the low level, and the second level of the comparison signal Sf is, but not limited to, the high level relative to the low level. Besides the above-mentioned high/low levels, other level scales for determining the input power source Pin and turning on/off the switch SW' would be used in the present disclosure.

Figure 7:
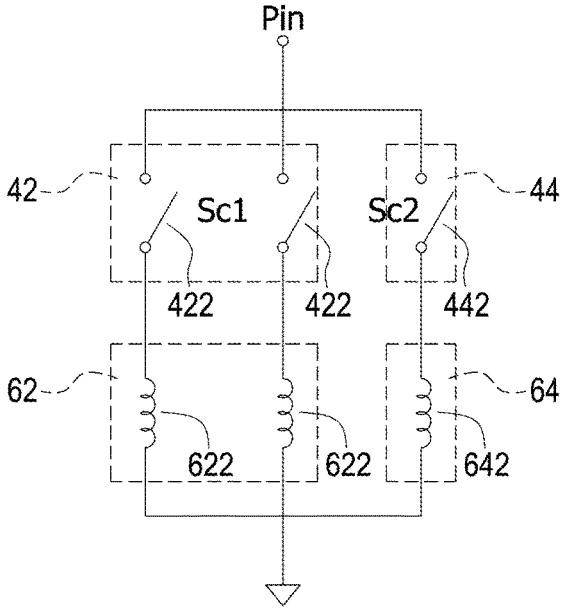
FIG. 7 is a schematic circuit diagram of a switch module and a heating module of the present disclosure.

Refer to FIG. 7, which shows a schematic circuit diagram of a switch module and a heating module of the present disclosure. The first switch assembly 42 includes at least one first switch unit 422 and the second switch assembly 44 includes at least one second switch unit 442. The at least one first switch unit 422 is correspondingly connected to at least one first heater 622 of the first heater assembly 62. The at least one second switch unit 442 is correspondingly connected to at least one second heater 642 of the second heater assembly 64. As shown in FIG. 7, the heating apparatus 100 includes two first switch units 422 and one second switch unit 442. Each of the two first switch units 422 is connected to one first heater 622. The second switch unit 442 is connected to one second heater 642. When the control unit 24 outputs the first control signal Sc1 with the second level to turn on the first switch assembly 42, the two first switch units 422 are turned on so that the two first heaters 622 generate output power and raise the temperature. When the control unit 24 outputs the second control signal Sc2 with the second level to turn on the second switch assembly 44, the second switch unit 442 is turned on so that the second heater 642 generates output power and raises the temperature. In one embodiment, the first heater 622 and the second heater 642 may be, but not limited to, resistance wire heaters, ceramic heaters, or carbon film heaters.

For example, the heating apparatus 100 offers 1000-watt output power. Also, the first switch assembly 42 includes two first switch units 422 and the second switch assembly 44 includes one second switch unit 442. Each first switch unit 422 is connected to one first heater 622 (AC 220 volts-500 watts of rated power). The second switch unit 442 is connected to one second heater 642 (AC 110 volts-500 watts of rated power). When the detection unit 22 detects that the amplitude of the input power source Pin is greater than the threshold voltage value T, the control unit 24 turns on the two first switch units 422 of the first switch assembly 42 and turns off the second switch unit 442 of the second switch assembly 44. Accordingly, the two first heaters 622 connected to the first switch units 422 generate output power and raise the temperature due to a current flowing through the two first heaters 622, and the second heater 642 connected to the second switch unit 442 is disabled due to no current flowing through the second heater 642. At this time, each of the first heaters 622 is supplied by AC 220 volts to generate an output power of 500 watts. Therefore, the total output power is 1000 watts in the first heating mode M1.

When the detection unit 22 detects that the amplitude of the input power source Pin is less than the threshold voltage value T, the control unit 24 first turns on the second switch unit 442 of the second switch assembly 44 and then turns on the two first switch units 422 of the first switch assembly 42. Accordingly, the second heater 642 first generates output power and raises the temperature and then the two first heaters 622 generate output power and raise the temperature. At this time, the second heater 642 is supplied by AC 110 volts to generate an output power of 500 watts and each of the first heaters 622 is supplied by AC 110 volts (instead of AC 220 volts) to generate an output power of 250 watts, namely one half of the rated output power of 500 watts. Therefore, the total output power is 1000 watts in the second heating mode M2. In other words, the total output power generated from the first switch assembly 42 and the second switch assembly 44 in the second heating mode M2 is equal to the total output power generated from the first switch assembly 42 and the second switch assembly 44 in the first heating mode M1.

In particular, the number of the switch units and the number of the heaters are exemplified for demonstration. In other words, the first switch assembly 42 may include four first switch units 422 and the four first switch units 422 are correspondingly connected to four first heaters 622. Also, the second switch assembly 44 may include two second switch units 442 and the two second switch units 442 are correspondingly connected to two second heaters 642. Similarly, the number of the total output power of the heating apparatus 100 is exemplified for demonstration. In other words, the key feature of the present disclosure is that the total output power generated from the first switch assembly 42 and the second switch assembly 44 in the first heating mode M1 is equal to the total output power generated from the first switch assembly 42 and the second switch assembly 44 in the second heating mode M2.

Figure 8:
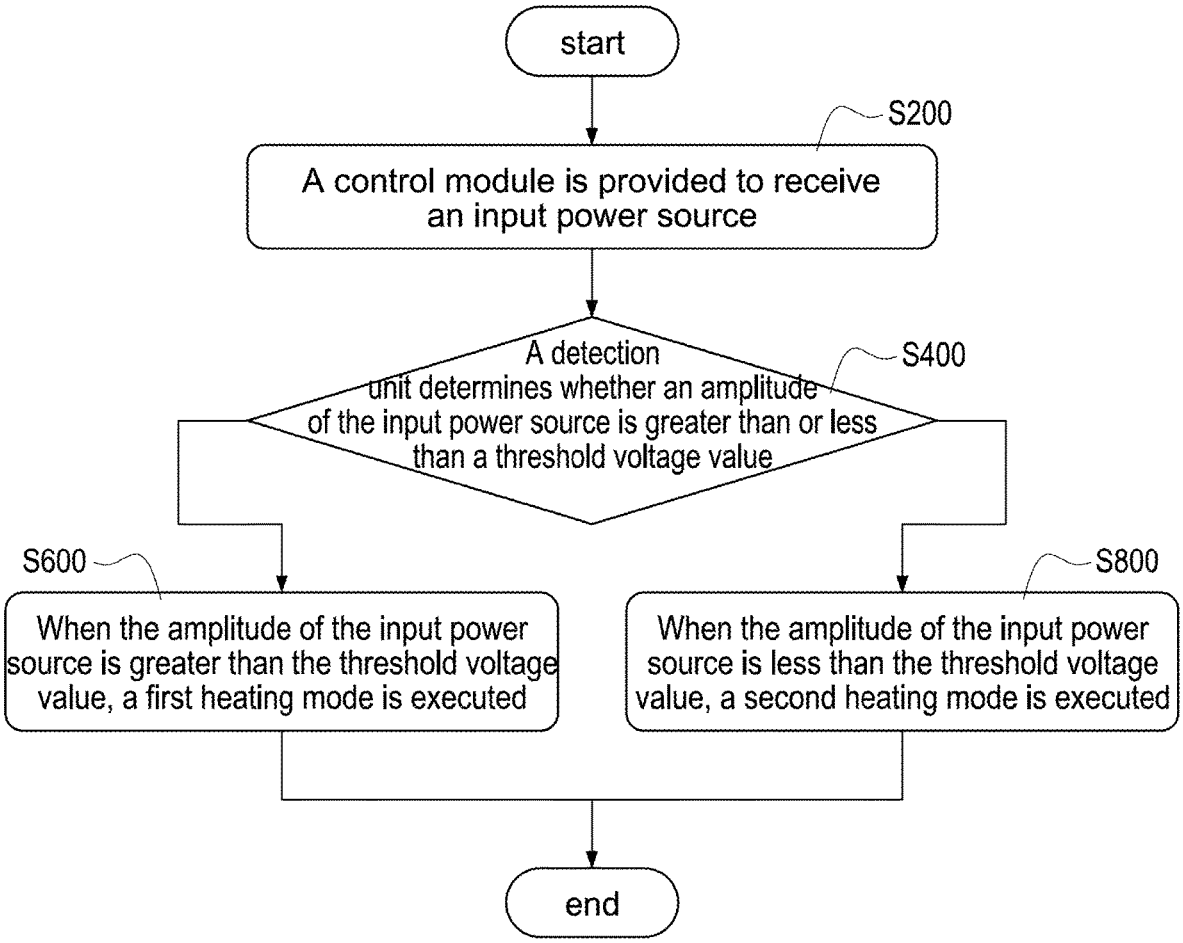
FIG. 8 is a flowchart of a method of operating a heating apparatus with automatic switching heaters according to the present disclosure.

Refer to FIG. 8, which shows a flowchart of a method of operating a heating apparatus with automatic switching heaters according to the present disclosure. The method of operating a heating apparatus with automatic switching heaters includes steps as follows. A control module 20 is provided to receive an input power source Pin (S200). The control module 20 includes a detection unit 22 and a control unit 24 connected to the detection unit 22. After receiving the input power source Pin, the control module 20 controls a switch module 40 so as to control a heating module 60 to generate power and raise the temperature according to on/off condition of the switch module 40, thereby automatically switching the heating apparatus 100 in a first heating mode M1 or a second heating mode M2.

Afterward, the detection unit 22 determines whether an amplitude of the input power source Pin is greater than or less than a threshold voltage value T (S400) and then outputs a detection signal Sd to the control unit 24. The control unit 24 receives the detection signal Sd and a delay time Td outputted from a delay unit 26. After a period of the delay time Td since the control unit 24 receives the detection signal Sd, the control unit 24 outputs a control signal Sc to control the heating apparatus 100 in the first heating mode M1 or the second heating mode M2.

When the amplitude of the input power source Pin is greater than the threshold voltage value T, the first heating mode M1 is executed (S600). The switch module 40 includes a first switch assembly 42 and a second switch assembly 44. The heating module 60 includes a first heater assembly 62 and a second heater assembly 64. The first heater assembly 62 and the second heater assembly 64 are correspondingly connected to the first heater assembly 62 and the second heater assembly 64. When the first heating mode M1 of the heating apparatus 100 is executed, the first switch assembly 42 is turned on but the second switch assembly 44 is turned off so that the first heater assembly 62 generates power and raises the temperature.

When the amplitude of the input power source Pin is less than the threshold voltage value T, the second heating mode M2 is executed (S800). When the second heating mode M2 of the heating apparatus 100 is executed, the first switch assembly 42 and the second switch assembly 44 are turned on so that both the first heater assembly 62 and the second heater assembly 64 generate power and raise the temperature. In order to avoid damages of the switch module 40 and/or the heating module 60 due to an overshoot in current when the switch module 40 is instantaneously turned on, the control unit 24 first controls the second heater assembly 64 to generate power and then controls the first heater assembly 62 to generate power. In particular, a total output power generated from the first switch assembly 42 and the second switch assembly 44 in the first heating mode M1 is equal to a total output power generated from the first switch assembly 42 and the second switch assembly 44 in the second heating mode M2.

In conclusion, the present disclosure has the following advantages:

1. The input power source Pin with a wide AC input voltage range is supplied to the heating apparatus 100. The heating apparatus 100 can receive the input power source Pin with the wide AC input voltage range to provide flexible and adaptive power applications so that the heating apparatus 100 can operate in the first heating mode M1 and the second heating mode M2 since the control module 20 is used to determine whether the input power Pin is greater than or less than the threshold voltage value T.

2. The heating apparatus 100 is automatically switched to select different amplitudes of the input power source Pin. After determining the amplitude of the input power source Pin according to the threshold voltage value T, the control module 20 automatically outputs the control signal Sc to control the switch module 40 without the user's manipulation, thereby increasing convenience of using the heating module 60.

3. The total heating ability of the first heater assembly 62 and the second heater assembly 64 can be held under different amplitudes of the input power source Pin. When the heating apparatus 100 is supplied by different amplitudes of the input power source Pin, the heating apparatus 100 is correspondingly switched to generate the same total output power generated from the first switch assembly 42 and the second switch assembly 44 in different heating modes.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. A heating apparatus with automatic switching heaters, the heating apparatus comprising:

a control module configured to receive an input power source;

a switch module connected to the control module, and the switch module comprising:

a first switch assembly connected to the control module and the heating module; and a second switch assembly connected to the control module and the heating module; and a heating module connected to the switch module;

wherein when the control module is configured to detect that an amplitude of the input power source is greater than a threshold voltage value, the control module is configured to output a control signal to control the switch module, and the switch module is configured to switch the heating module to operate in a first heating mode, the control module is configured to turn on the first switch assembly and turn off the second switch assembly; when the control module is configured to detect that the amplitude of the input power source is less than the threshold voltage value, the control module is configured to output the control signal to control the switch module, and the switch module is configured to switch the heating module to operate in a second heating mode, the control module is configured to turn on the first switch assembly and the second switch assembly;

wherein in the second heating mode, the control unit is configured to turn on the second switch assembly and then turn on the first switch assembly.

2. The heating apparatus as claimed in claim 1, wherein the control module comprises a detection unit configured to receive the input power source, and the detection unit comprises:

a rectifying unit configured to receive the input power source; and a level output unit connected to the rectifying unit;

wherein the rectifying unit is configured to rectify the input power source into a DC power source; when the level output unit is configured to determine that an amplitude of the DC power source is greater than a voltage value corresponding to the threshold voltage value, the level output unit is configured to output a detection signal with a first level, and the control module is configured to control the heating module operating in the first heating mode according to the detection signal with the first level; when the level output unit is configured to determine that the amplitude of the DC power source is less than the voltage value corresponding to the threshold voltage value, the level output unit is configured to output the detection signal with a second level, and the control module is configured to control the heating module operating in the second heating mode according to the detection signal with the second level.

3. The heating apparatus as claimed in claim 2, wherein the level output unit comprises:

a comparison unit connected to the rectifying unit; and a photo coupling unit connected to the comparison unit;

wherein the comparison unit is configured to control the photo coupling unit according to an amplitude relationship between the amplitude of the DC power source and the voltage value corresponding to the threshold voltage value; when the amplitude of the DC power source is greater than the voltage value corresponding to the threshold voltage value, the comparison unit is configured to turn on the photo coupling unit, and the photo coupling unit is configured to output the detection signal with the first level; when the amplitude of the DC power source is less than the voltage value corresponding to the threshold voltage value, the comparison unit is configured to turn off the photo coupling unit, and the photo coupling unit is configured to output the detection signal with the second level.

4. The heating apparatus as claimed in claim 3, wherein the comparison unit comprises:

a voltage dividing loop comprising:

a Zener diode; and a first resistor connected in series to the Zener diode; and a switch connected to the Zener diode, the first resistor, and the photo coupling unit;

wherein when the amplitude of the DC power source is greater than the voltage value corresponding to the threshold voltage value, a voltage across the first resistor is turned on the switch and the photo coupling unit, and the photo coupling unit is configured to output the detection signal with the first level; when the amplitude of the DC power source is less than the voltage value corresponding to the threshold voltage value, the voltage across the first resistor is turned off the switch and the photo coupling unit, and the photo coupling unit is configured to output the detection signal with the second level.

5. The heating apparatus as claimed in claim 3, wherein the comparison unit comprises:

a voltage dividing circuit comprising:

a first resistor; and a second resistor connected in series to the first resistor; and a voltage dividing loop, comprising:

a comparator; and a switch connected to the comparator; one input terminal of the comparator is connected to the first resistor and the second resistor, and the switch is connected to the other input terminal of the comparator and the photo coupling unit;

wherein when the amplitude of the DC power source is greater than the voltage value corresponding to the threshold voltage value, the comparator is configured to turn on the photo coupling unit by turning on the switch, and the photo coupling unit is configured to output the detection signal with the first level; when the amplitude of the DC power source is less than the voltage value corresponding to the threshold voltage value, the comparator is configured to turn off the photo coupling unit by turning off the switch, and the photo coupling unit is configured to output the detection signal with the second level.

6. The heating apparatus as claimed in claim 2, wherein the control module further comprises:

a control unit connected to the detection unit and the switch module;

wherein after the detection unit is configured to receive the input power source, the detection unit is configured to output the detection signal to the control unit, and the control unit is configured to control the heating module operating in the first heating mode or the second heating mode; when the detection unit is configured to determine that the amplitude of the input power source is greater than the threshold voltage value, the control unit is configured to control the heating module operating in the first heating mode according to the detection signal; when the detection unit is configured to determine that the amplitude of the input power source is less than the threshold voltage value, the control unit is configured to control the heating module operating in the second heating mode according to the detection signal.

7. The heating apparatus as claimed in claim 6, wherein the control module further comprises:

a delay unit connected to the control unit and configured to output a delay time to the control unit;

wherein after a period of the delay time since the control unit is configured to receive the detection signal, the control unit is configured to output the control signal to the switch module.

8. The heating apparatus as claimed in claim 2, wherein the threshold voltage value is AC 150 volts; when the amplitude of the input power source is AC 220 volts, the level output unit is configured to determine that the amplitude of the DC power source is greater than the voltage value corresponding to the threshold voltage value; when the amplitude of the input power source is AC 110 volts, the level output unit is configured to determine that the amplitude of the DC power source is less than the voltage value corresponding to the threshold voltage value.

9. The heating apparatus as claimed in claim 1, wherein the heating module comprises:

a first heater assembly connected to the first switch assembly; and a second heater assembly connected to the second switch assembly;

wherein when the first switch assembly is turned on and the second switch assembly is turned off, the first heater assembly is configured to generate output power and raise the temperature; when the first switch assembly and the second switch assembly are turned on, the first heater assembly and the second heater assembly are configured to generate output power and raise the temperature.

10. The heating apparatus as claimed in claim 9, wherein the control module is configured to first turn on the second switch assembly and then turn on the first switch assembly when both the first heater assembly and the second heater assembly are configured to generate output power and raise the temperature.

11. The heating apparatus as claimed in claim 1, wherein a total output power generated from the heating module in the first heating mode is equal to the total output power generated from the heating module in the second heating mode.

12. A method of operating a heating apparatus with automatic switching heaters, the method comprising:

(a) providing a control module to receive an input power source;

(b) determining whether an amplitude of the input power source is greater than or less than a threshold voltage value by the control module;

(c) switching a heating module operating in a first heating mode by the control module, and generating output power from a first heater assembly of the heating module and raising the temperature when the amplitude of the input power source is greater than the threshold voltage value; and (d) switching the heating module operating in a second heating mode by the control module and generating output power from the first heater assembly and a second heater assembly of the heating module and raising the temperature when the amplitude of the input power source is less than the threshold voltage value;

(d1) first controlling, by the control module, the second heater assembly raised the temperature and then controlling the first heater assembly raised the temperature in the second heating mode.

13. The method of operating the heating apparatus as claimed in claim 12, wherein the step (b) further comprises:

(b1) providing a detection unit and a control unit connected to the detection unit of the control module, and receiving a delay time by the control unit; outputting a detection signal to the control unit by the detection unit after the detection unit is configured to determine an amplitude relationship between the amplitude of the input power source and the threshold voltage value; switching the heating module to operate in the first heating mode or in the second heating mode by a switch module after a period of the delay time since the control unit is configured to receive the detection signal.

14. The method of operating the heating apparatus as claimed in claim 12, wherein a total output power generated from the heating module in the first heating mode is equal to the total output power generated from the heating module in the second heating mode.

* * * * *